US010260715B2

(12) United States Patent
Chen et al.

(10) Patent No.: US 10,260,715 B2
(45) Date of Patent: Apr. 16, 2019

(54) LED MODULE AND ILLUMINATION DEVICE

(71) Applicant: HANGZHOU HPWINNER OPTO CORPORATION, Hangzhou, Zhejiang Province (CN)

(72) Inventors: Kai Chen, Hangzhou (CN); Jianming Huang, Hangzhou (CN)

(73) Assignee: HANGZHOU HPWINNER OPTO CORPORATION, Hangzhou, Zhejiang (CN)

( * ) Notice: Subject to any disclaimer, the term of this patent is extended or adjusted under 35 U.S.C. 154(b) by 0 days.

(21) Appl. No.: 15/557,593

(22) PCT Filed: Mar. 14, 2016

(86) PCT No.: PCT/CN2016/076308
§ 371 (c)(1),
(2) Date: Sep. 12, 2017

(87) PCT Pub. No.: WO2016/146047
PCT Pub. Date: Sep. 22, 2016

(65) Prior Publication Data

US 2018/0045399 A1 Feb. 15, 2018

(30) Foreign Application Priority Data

Mar. 13, 2015 (CN) ..... 2015 1 0110569
Mar. 13, 2015 (CN) ..... 2015 2 0143091 U

(51) Int. Cl.
*F21V 17/12* (2006.01)
*F21V 31/00* (2006.01)
(Continued)

(52) U.S. Cl.
CPC ..... *F21V 17/12* (2013.01); *F21K 9/00* (2013.01); *F21V 19/0055* (2013.01);
(Continued)

(58) Field of Classification Search
CPC ..... F21V 17/12; F21V 31/005
(Continued)

(56) References Cited

U.S. PATENT DOCUMENTS 9,322,520 B1 * 4/2016 Li ..... G02B 6/0011
2006/0132934 A1 6/2006 Hille
(Continued)

FOREIGN PATENT DOCUMENTS

CN 201014275 Y 1/2008
CN 203052233 U 7/2013
(Continued)

*Primary Examiner* — Toan C Ly
(74) *Attorney, Agent, or Firm* — Muncy, Geissler, Olds & Lowe, P.C.

(57) ABSTRACT

An LED module having a base, a lens assembly, and a light source assembly. The lens assembly has an internal thread and the base has a matching external thread. The lens assembly and base are connected by the threads to form a closed accommodating space. A sealing ring is disposed at a portion between the thread connection of the base, lens assembly, and accommodating space. The light source assembly is in the accommodating space and at one side of the base. The lens assembly and the base are in threaded connection, providing an increased force bearing surface and even force bearing therebetween, resulting in a secure connection, good leakproofness, and convenient installation and removal. The sealing ring is disposed at the connection of the lens assembly and the base, allowing for an excellent sealing effect between the lens assembly and the base.

21 Claims, 11 Drawing Sheets

(51) Int. Cl.

| | |
|---|---|
| ***F21V 29/77*** | (2015.01) |
| ***F21K 9/00*** | (2016.01) |
| ***F21V 19/00*** | (2006.01) |
| ***F21V 29/74*** | (2015.01) |
| *F21Y 115/10* | (2016.01) |
| *F21V 5/04* | (2006.01) |
| *F21V 23/06* | (2006.01) |

(52) U.S. Cl.
CPC ..... *F21V 29/74* (2015.01); *F21V 29/773* (2015.01); *F21V 31/005* (2013.01); *F21V 5/04* (2013.01); *F21V 23/06* (2013.01); *F21Y 2115/10* (2016.08)

(58) Field of Classification Search
USPC ..... 362/311.02
See application file for complete search history.

(56) References Cited

U.S. PATENT DOCUMENTS

2010/0315815 A1* 12/2010 Lin ..... F21K 9/00
362/249.01
2015/0273365 A1* 10/2015 Laverdiere ..... B01D 65/00
210/321.6

FOREIGN PATENT DOCUMENTS

| | | | |
|---|---|---|---|
| CN | 203131490 | U | 8/2013 |
| CN | 204403886 | U | 6/2015 |
| CN | 105042356 | A | 11/2015 |
| JP | 2000057813 | A | 2/2000 |

* cited by examiner

LED MODULE AND ILLUMINATION DEVICE

TECHNICAL FIELD

The present invention relates to the technical field of lighting device design, and in particular to an LED module and a lighting device.

BACKGROUND ART

An LED lamp has the advantages of energy saving, long service life, good adaptability, short response time, environmental friendliness and so on, and is the trend of development of the lighting industry. An LED module is an essential part-of an LED lamp, and typically, the LED module is constituted by a lens assembly, a light source assembly, and a radiator, with the light source assembly being disposed on the radiator and the lens assembly being disposed to cover the radiator such that the light source assembly being disposed between the lens assembly and the radiator.

In the prior art, the lens assembly is typically connected to the radiator using a screw, in a snap-fitting way, or the like. Such connection ways have disadvantages such as troublesome installation, easy loosing, and insecure connection, which may then affect the sealing performance between the lens assembly and the radiator, resulting in a poor sealing effect. In addition, the connection using a screw and the connection of snap-fitting between the lens assembly and the radiator belongs to a point force bearing connection way with limited force bearing points, and small and uneven force bearing area, leading to an insecure connection and a poor sealing effect.

SUMMARY OF THE INVENTION

To solve the above problems, the present invention provides an LED module, which comprises:

a base, a lens assembly, and a light source assembly, wherein the lens assembly is provided with an internal thread; the base is correspondingly provided with an external thread matching the internal thread; the lens assembly and the base are connected by means of the threads to form a closed accommodating space therebetween; moreover, a sealing ring is also disposed at a portion between a threaded connection of the base and the lens assembly and the accommodating space; and the light source assembly is located in the accommodating space, and disposed at one side of the base.

Preferably, the sealing ring is a stepped sealing ring that comprises a cylindrical portion having a greater peripheral radial size and a cylindrical portion having a smaller peripheral radial size; the lens assembly is provided with a first matching structure matching the stepped sealing ring, and the base is provided with a second matching structure matching the stepped sealing ring.

Preferably, the lens assembly is provided with an annular protruding part in a direction from a peripheral edge thereof to the base; the annular protruding part is a hollow cylinder with a thickness; the annular protruding part is provided with an annular groove and an opening of the annular groove faces the base; the annular groove is formed by a first circumferential side surface, a second circumferential side surface, and a groove bottom surface; the first circumferential side surface is located at a periphery of the second circumferential side surface, and is provided with the internal thread; and the groove bottom surface and the second circumferential side surface together form the first matching structure; and the external thread of the base and the second matching structure are disposed as follows: an annular protruding wall is disposed on an end face, facing the lens assembly, of the base, and the light source assembly is located in an area enclosed by the annular protruding wall; the annular protruding wall is capable of extending into the annular groove of the lens assembly, and an external side surface of the annular protruding wall is provided with the external thread; and an upper surface of the annular protruding wall and an internal side surface of the annular protruding wall together form the second matching structure.

Preferably, the lens assembly is provided with an annular protruding part in a direction from a peripheral edge thereof to the base; the annular protruding part is a hollow cylinder with a thickness; the annular protruding part is provided with an annular groove and an opening of the annular groove faces the base; the annular groove is formed by a first circumferential side surface, a second circumferential side surface, and a groove bottom surface; the first circumferential side surface is located at a periphery of the second circumferential side surface, and is provided with the internal thread; the groove bottom surface is stepped and comprises a deeper first bottom surface, a shallower second bottom surface, and a first transitional mesa therebetween; the first bottom surface adjoins the first circumferential side surface; the second bottom surface adjoins the second circumferential side surface; and the second bottom surface and the second circumferential side surface together form the first matching structure; and the external thread of the base and the second matching structure are disposed as follows: an annular protruding wall is disposed on an end face, facing the lens assembly, of the base, and the light source assembly is located in an area enclosed by the annular protruding wall; the annular protruding wall is capable of extending into the annular groove of the lens assembly, and an external side surface of the annular protruding wall is provided with the external thread; an internal side surface of the annular protruding wall is stepped and comprises a third circumferential side surface located in the upper part, a fourth circumferential side surface located in the lower part, and a second transitional mesa therebetween, and the fourth circumferential side surface and the second transitional mesa together form the second matching structure.

Preferably, a plurality of groups of barbs are disposed on an external circumferential surface of the cylindrical portion having the smaller peripheral radial size of the stepped sealing ring.

Preferably, the external circumferential surface of the cylindrical portion having the smaller peripheral radial size of the stepped sealing ring is a circular conical surface, wherein the radial size of an end, connected with the cylindrical portion having the greater peripheral radial size, of the cylindrical portion having the smaller peripheral radial size is greater than that of the other end of the cylindrical portion having the smaller peripheral radial size.

Preferably, an axial section of the sealing ring is wedge-shaped, and an external circumferential surface of the sealing ring is a circular conical surface big in top and small in bottom; correspondingly, the lens assembly is provided with a third matching structure matching the stepped sealing ring, and the base is provided with a fourth matching structure matching the stepped sealing ring.

Preferably, the lens assembly is provided on a surface facing the light source assembly with an annular lug boss that is located at an inner side of the internal thread of the lens assembly, and the annular lug boss has a distance from the internal thread of the lens assembly, thereby form a second groove bottom surface; the base is provided with a second annular groove that comprises a bottom surface and a slope-shaped internal side surface, and a second annular protruding wall is formed to surround the second annular groove, wherein an external circumferential surface of the annular lug boss and a portion of the second groove bottom surface adjacent thereto together form the third matching structure; and an internal side surface of the second annular groove of the base and a portion of the bottom surface adjacent thereto together form the fourth matching structure.

Preferably, an upper surface of the annular protruding wall or the second annular protruding wall of the base is provided with a groove which is filled with a sealant.

Preferably, the lens assembly comprises a lens portion and a threaded connection portion, and the lens portion and the threaded connection portion are integrally molded or fixedly connected.

Preferably, the lens assembly is composed of a lens and a lens pressing ring; and the lens pressing ring presses the lens against the base, and the lens pressing ring is in threaded connection with the base.

Preferably, the lens is fixedly disposed on the base; wherein a positioning column is disposed at a side, opposite to the base, of the lens, and a positioning hole is correspondingly provided in an upper end face of the base.

Preferably, the annular protruding part of the lens assembly is circumferentially provided along an edge thereof with a first equidirectional tooth-shaped structure; the base is provided with a second equidirectional tooth-shaped structure matching the first equidirectional tooth-shaped structure; and after the lens assembly is connected with the base by means of the threads, the first equidirectional tooth-shaped structure is engaged and locked with the second equidirectional tooth-shaped structure.

Preferably, the internal thread and the external thread are double threads matching each other.

Preferably, the closed accommodating space formed by the lens assembly and the base is filled with a packaging colloid.

Preferably, one or more heat dissipation structures are disposed on a side, departing from the lens assembly, of the base; each heat dissipation structure comprises a plurality of flaky fins and a plurality of columnar fins; the plurality of flaky fins are disposed in a middle position, and the plurality of columnar fins are disposed around the flaky fins.

Preferably, a protruding wall is disposed at a periphery of a light-exiting surface of the lens assembly, and a light-reflecting layer is disposed on an internal side surface of the protruding wall.

The present invention also provides an LED module, which comprises:

a base, a lens assembly, and a light source assembly, wherein the lens assembly is provided with an external thread; the base is correspondingly provided with an internal thread matching the external thread; the lens assembly and the base are connected by means of the threads to form a closed accommodating space therebetween; moreover, a sealing ring is also disposed at a portion between a threaded connection of the base and the lens assembly and the accommodating space; and the light source assembly is located in the accommodating space, and is disposed at one side of the base.

The present invention also provides a lighting device. At least one LED module is disposed in the lighting device, and the LED module is the LED module of any one of the above descriptions.

By using the above technical solutions, the present invention has the following advantages and positive effects as compared to the prior art:

1) Regarding the LED provided in the present invention, the lens assembly and the base therein are connected by means of threads, and both are cylindrical at the threaded connection. Moreover, the matching sealing ring is disposed, thereby achieving good sealing performance of the LED module. Compared to the connection ways such as using a screw or a snap fitting in the prior art, the force bearing surface between the lens assembly and the base in the present invention is increased and even force bearing is achieved, resulting in a secure connection and good leak-proofness between the lens assembly and the base. Furthermore, the threaded connection way facilitates installation and removal of the lens assembly and the base.

2) Regarding the LED module provided in the present invention, the first matching structure and the second matching structure are disposed at the connections of the lens assembly and the base, respectively. The stepped sealing ring is disposed between the first matching structure and the second matching structure, and preferably, the sealant is also provided therebetween, thus leading to a good sealing effect between the lens assembly and the base.

3) Regarding the LED module provided in the present invention, the third matching structure and the fourth matching structure are disposed at the connections of the lens assembly and the base, respectively. The wedge-shaped sealing ring is disposed between the third matching structure and the fourth matching structure, and preferably, the sealant is also provided therebetween, thus leading to a good sealing effect between the lens assembly and the base.

4) Regarding the LED module provided in the present invention, in addition to achieving a rotary connection between the lens and the base by means of threaded connection, automatic locking and light distribution positioning between the base and the lens assembly may also be achieved by means of engagement between the first equidirectional tooth-shaped structure and the second equidirectional tooth-shaped structure or by means of matching of the positioning column of the lens assembly and the positioning hole of the base, thereby strengthening the connection between the lens assembly and the base and preventing the two from becoming loose. Also, the problem that light distribution is required for some lenses is solved.

5) Regarding the base in the LED module provided in the present invention, the flaky fins and the columnar fins are combined as the heat dissipation portion of the base, the flaky fins function in increasing the heat dissipation area and the columnar fins function in improving the overall structural strength. Therefore, the present invention not only ensures the heat dissipation effect, but also enhances the strength of the base.

BRIEF DESCRIPTION OF THE DRAWINGS

Clearer understandings of the above and other features and advantages of the present invention may be provided through the following detailed descriptions in connection with the accompanying drawings in which.

REFERENCE NUMBERS REPRESENT

2*a*, base; 3*a*, light source assembly; 1*a*, lens; 4*a*, stepped sealing ring; 10*a*, annular groove; 101, first circumferential side surface; 102, second circumferential side surface; 103, first bottom surface; 104, second bottom surface; 105, first transitional mesa; 201*a*, annular protruding wall; 5, screw; 202, third circumferential side surface; 204, fourth circumferential side surface; 203, second transitional mesa; 41, first flange; 42, cylindrical portion having a smaller radial size; 421, external circumferential surface; 422, barb; 411, first end face; 412, axial end face; 43, internal peripheral surface; 423, second end face; 1*b*, light distribution lens; 2*b*, base; 3*b*, light source assembly; 106, protruding light distribution structure; 2*c*, base; 1*c*, lens; 8, lens pressing ring; 10*c*, annular groove; 201*c*, annular protruding wall; 801, internal thread; 205, external thread; 4*c*, stepped sealing ring; 2*d*, base; 1*d*, lens; 107, first equidirectional tooth-shaped structure; 207, second equidirectional tooth-shaped structure; 20*d*, base; 205*d*, external thread; 4*d*, stepped sealing ring; 3*e*, PCBA; 2*e*, base; 6, installation support; 4*e*, sealing ring; le, lens; 11, bulb portion; 12, first threaded connection portion; 22, second threaded connection portion; 21, bottom surface; 23, internal side surface; 13, annular lug boss; 24, annular groove; 7, waterproof joint; and 9, waterproof wire.

DETAILED DESCRIPTION OF THE INVENTION

The present invention will be described below in more detail with reference to the accompanying drawings of the embodiments of the present invention. Nevertheless, the present invention can be implemented in many different forms, and should not be interpreted as being limited to the embodiments presented herein. Instead, these embodiments are intended to achieve full and complete disclosure and provide a full understanding of the scope of the present invention to those skilled in the related technical field. For the sake of clarity, the sizes and relative sizes of layers and regions may be enlarged in these drawings.

Embodiment 1

Figure 1:
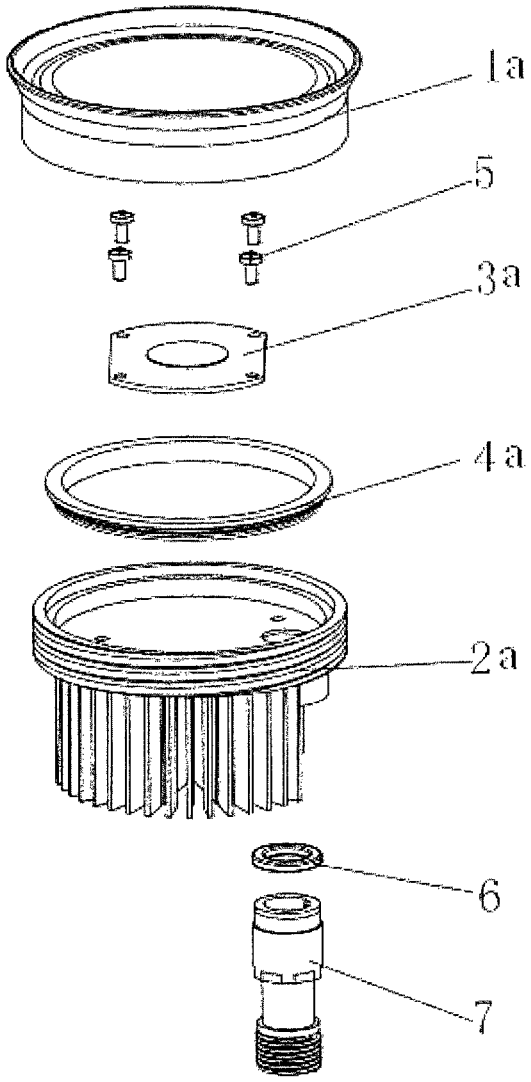
FIG. 1 is an exploded schematic diagram of embodiment 1 of the present invention.
Figure 2:
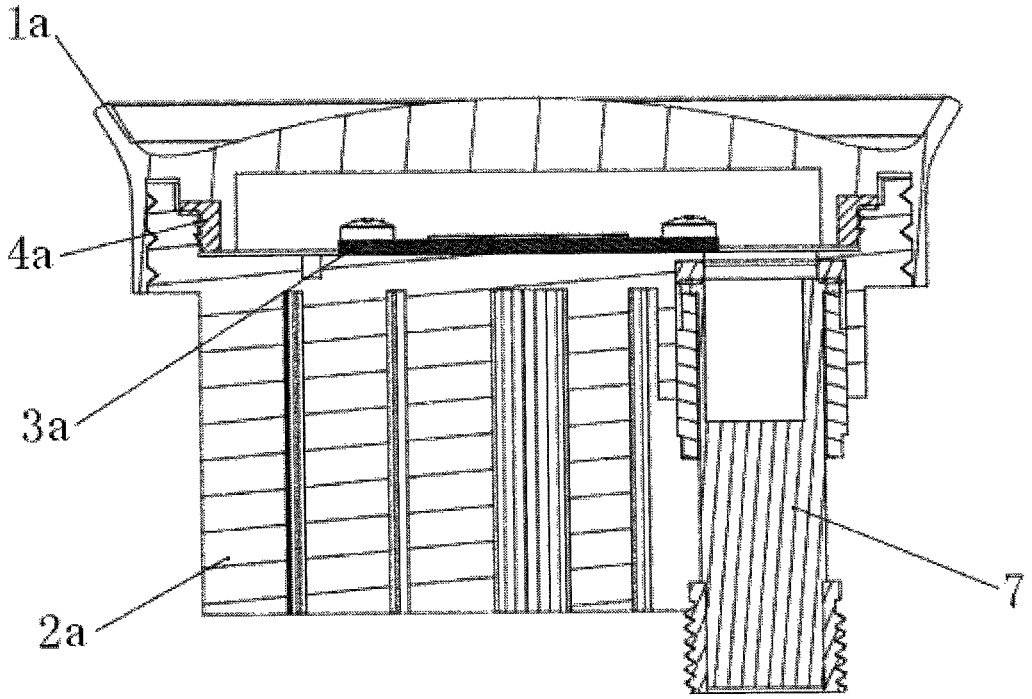
FIG. 2 is a sectional diagram of embodiment 1 of the present invention.

Referring to FIG. 1 and FIG. 2, the present embodiment provides an LED module. The LED module comprises a lens assembly, a base 2*a*, and a light source assembly 3*a*, wherein the lens assembly is provided with an internal thread, while the base 2*a* is correspondingly provided with an external thread matching the internal thread, and the lens assembly and the base 2*a* are connected by means of the threads to form a closed accommodating space therebetween. Moreover, a sealing ring is also disposed at a portion between the threaded connection of the base and the lens assembly and the accommodating space. The light source assembly 3*a* is located in the accommodating space, and disposed at one side of the base 2*a*. Specifically, the light source assembly 3*a* may be composed of a substrate and a plurality of LED light emitters disposed on the substrate. The substrate may be, for example, a PCBA. Certainly, the specific structural form of the light source assembly is not limited to this, and may also be other structural forms such as COB, which is not limited herein.

Figure 3:
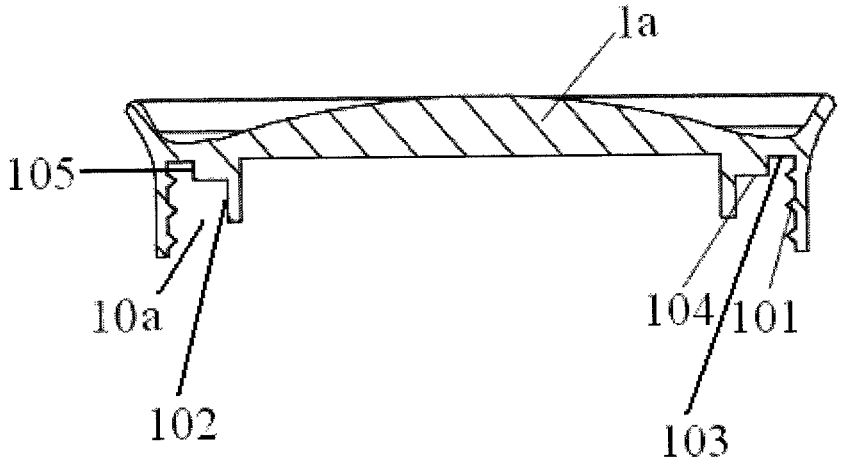
FIG. 3 is a schematic structure diagram of a lens assembly of embodiment 1 of the present invention.

In this embodiment, the lens assembly is lens 1*a*, as shown in FIG. 3 which is a section diagram of the lens. The entire outer contour of the lens in this embodiment is cylindrical. Certainly, it may also be in other shapes as long as the threaded connection portion thereof is cylindrical, which is not limited herein.

Referring to FIG. 1, FIG. 2 and FIG. 3, in this embodiment, lens 1*a* is shaped into a bottle cap with one end open. The lens 1*a* comprises a lens portion and a threaded connection portion. In this embodiment, the lens 1*a* is an integrated injection-molded lens, and therefore, the lens and the threaded connection portion are integrally molded. In other implementations, the lens may also be a combined assembled lens, and in this case, the lens portion and the threaded connection portion may be fixedly connected, for example, being glued or welded, which is not limited herein.

Preferably in this embodiment, a protruding wall is disposed at a periphery of a light-exiting surface of the lens 1*a*, and a light-reflecting layer is disposed on an internal side surface of the protruding wall to improve luminous efficacy. The light-reflecting layer may be disposed by way of spraying a high-reflectivity ink, or gluing a high-reflectivity film, or electroplating a high-reflectivity metal film, which is not limited herein.

Figure 4:
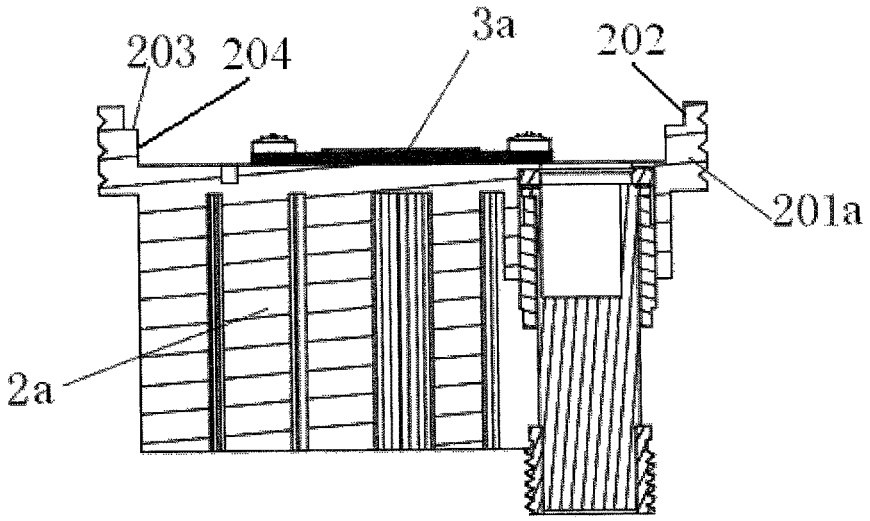
FIG. 4 is a schematic structure diagram of a base of embodiment 1 of the present invention.

Referring to FIG. 1, FIG. 2 and FIG. 4, the sealing ring of this embodiment is a stepped sealing ring 4*a* that comprises a cylindrical portion having a greater peripheral radial size and a cylindrical portion having a smaller peripheral radial size. Moreover, the lens 1*a* is provided with a first matching structure matching the stepped sealing ring 4*a*, and the base 2*a* is provided with a second matching structure matching the stepped sealing ring 4*a*. Compared with a conventional sealing ring like an O-shaped sealing ring, the stepped sealing ring has a greater contact area and a longer sealing loop, thereby providing a better sealing effect. In other implementations of the present invention, the sealing ring may also be conventional sealing rings of other types, such as an O-shaped sealing ring, and the specific type of the sealing ring is not limited herein.

Referring to FIG. 1, FIG. 3 and FIG. 4, specific details are provided below.

In this embodiment, the internal thread of the lens 1*a* and the first matching structure thereof are specifically disposed as follows: the lens 1*a* is provided with an annular protruding part in a direction from a peripheral edge thereof to the base 2*a*. The annular protruding part is a hollow cylinder with a thickness. The annular protruding part is provided with an annular groove 10*a* and an opening of the annular groove 10*a* faces the base 2*a*. The annular groove 10*a* is formed by a first circumferential side surface 101, a second circumferential side surface 102, and a groove bottom surface. The first circumferential side surface 101 is located at an outer circle of the second circumferential side surface 102, and is provided with the internal thread. The groove bottom surface is stepped and comprises a deeper first bottom surface 103, a shallower second bottom surface 104, and a first transitional mesa 105 therebetween. The first bottom surface 103 adjoins the first circumferential side surface 101. The second bottom surface 104 adjoins the second circumferential side surface 102, and the second bottom surface 104 and the second circumferential side surface 102 together form the first matching structure.

The external thread of the base 2*a* and the second matching structure are disposed as follows: an annular protruding wall 201*a* is disposed on an end face, facing the lens 1*a*, of the base 2*a*. The light source assembly 3*a* is located in an area enclosed by the annular protruding wall 201*a*, and the light source assembly 3*a* is fixedly connected with the upper end face of the base 2*a*, and specifically by means of a connection structure, such as a screw 5. The annular protruding wall 201*a* is capable of extending into the annular groove 10*a* of the lens 1*a*, and an external side surface of the annular protruding wall 201*a* is provided with the external thread. An internal side surface of the annular protruding wall 201*a* is stepped and comprises a third circumferential side surface 202 located in the upper part, a fourth circumferential side surface 204 located in the lower part, and a second transitional mesa 203 therebetween, and the fourth circumferential side surface 204 and the second transitional mesa 203 together form the second matching structure.

The above is merely a specific implementation of the first matching structure and the second matching structure. In other implementations of the present invention, the groove bottom surface of the annular groove of the annular protruding part of the lens may be a surface rather than the above stepped surface. Correspondingly, the internal side surface of the annular protruding wall of the base may also just be a surface rather than the above stepped surface. In such an implementation, the first matching structure matching the stepped sealing ring is the groove bottom surface and the second circumferential side surface of the annular protruding part of the lens, and the second matching structure matching the stepped sealing ring is the upper surface and the internal side surface of the annular protruding wall of the base.

Additionally, the groove bottom surface of the annular groove of the annular protruding part of the lens and the internal side surface of the annular protruding wall of the base may also be provided with a plurality of steps as required, which is not limited herein.

Several first matching structures and second matching structures described above can all well match the stepped sealing ring to achieve an excellent leakproofness.

When the lens 1*a* and the base 2*a* in this embodiment are connected by means of the threads, the annular protruding wall 201*a* of the base 2*a* extends into the annular groove 10*a* of the lens 1*a*, and the lens 1*a* and the base 2*a* are rotated relative to each other such that the internal thread of the lens 1*a* is connected with the external thread of the base 2*a*. Moreover, the first matching structure and the second matching structure both come into contact with the stepped sealing ring 4*a* and axially hold down the stepped sealing ring 4*a* at the internal thread of the lens 1*a*, thereby achieving sealing. As the lens 1*a* and the base 2*a* in the present invention are connected by means of the threads rotation, it facilitates the connection between the lens 1*a* and the base 2*a* and tool-free installation and removal can be achieved on one hand; on the other hand, the connection surfaces of the lens 1*a* and the base 2*a* are of a circular structure, and the two are connected by means of the threads. Such a connection way, as compared to the connection ways such as using a screw or a snap fitting in the prior art, has the advantages that the force bearing surface between the lens 1*a* and the base 2*a* is increased and that the force bearing is even, resulting in a more secure connection between the lens 1*a* and the base 2*a*. Moreover, with the stepped sealing ring 4*a*, the LED module is provided with a good leakproofness.

Figure 5:
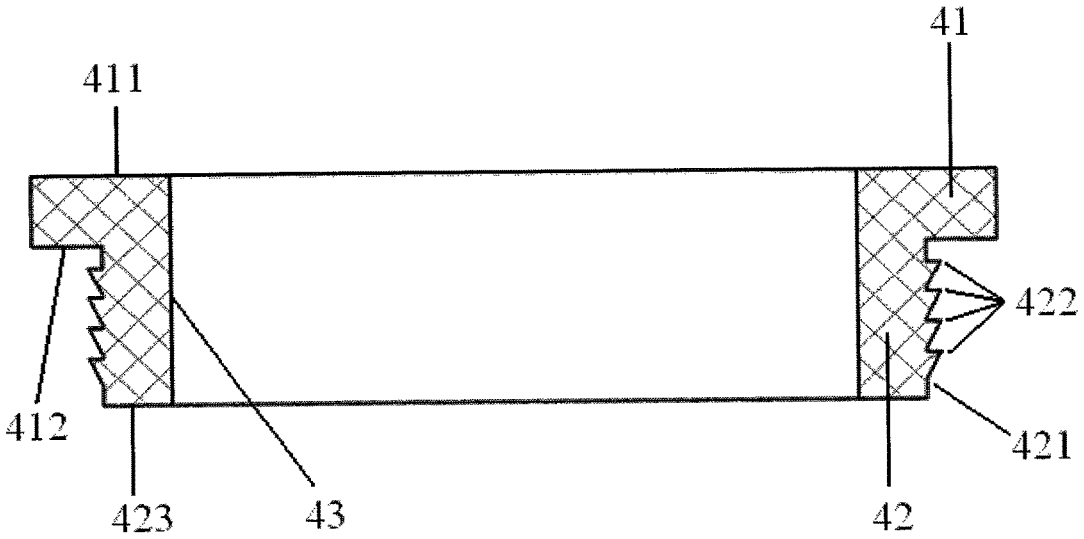
FIG. 5 is a schematic structure diagram of a sealing ring of embodiment 1 of the present invention.

As can be seen in FIG. 1, in this embodiment, the section of the stepped sealing ring 4*a* in the axial direction of the sealing ring is all stepped type. The structure of the stepped sealing ring 4*a* is as shown in FIG. 2 and FIG. 5. The stepped sealing ring 4*a* is a hollow cylinder with a shaft shoulder. The cylindrical portion having the greater peripheral radial size of the stepped sealing ring 4*a* is a first flange 41. A plurality of groups of barbs 422 are also disposed on the external circumferential surface 421 of the cylindrical portion having the smaller radial size 42 of the stepped sealing ring, and the heads of these barbs 422 point to the first flange 41.

Referring to FIG. 2 and FIG. 5, the first end face 411 of first flange 41 of the stepped sealing ring 4*a* is in contact with the second bottom surface 104 of the lens 1*a*. An axial end face 412, adjoining the outer end face of the cylindrical portion having the smaller radial size 42 of the stepped sealing ring 4*a*, of the first flange 41 is in contact with a second transitional mesa 203 of the base. The internal peripheral surface 43 of the stepped sealing ring 4*a* is in contact with the second circumferential side surface 102 of the lens 1*a*, and the external circumferential surface 421 of the cylindrical portion having the smaller radial size 42 of the stepped sealing ring 4*a* is in contact with the fourth circumferential side surface 204 of the base 2*a*.

Further preferably in this embodiment, the external circumferential surface 421 of the cylindrical portion having the smaller radial size 42 of the stepped sealing ring 4*a* is a circular conical surface, wherein the radial size of an end, connected with the first flange 41, of the cylindrical portion having the smaller peripheral radial size 42 is greater than that of the other end of the cylindrical portion having the smaller peripheral radial size 42. That is, the second end face 423 of the cylindrical portion having the smaller radial size 42 of the stepped sealing ring 4*a* is the smallest-size end. Corresponding, the fourth circumferential side surface 204 of the base 2*a* is also a circular conical surface, and an end, adjoining the second transitional mesa 203 of the base, of the cylindrical portion having the smaller radial size 42 of the stepped sealing ring 4*a* has the largest radial size.

In this embodiment, a sealant is also disposed between the second bottom surface 104 of the lens 1*a* and the second transitional mesa 203 of the base 2*a* to further enhance the sealing effect between the lens 1*a* and the base 2*a*.

In this embodiment, the closed accommodating space formed between the lens 1*a* and the base 2*a* may also be filled with a packaging colloid to improve luminous efficacy.

The installation process of the LED module of this embodiment is as follows.

The assembled light source assembly 3*a* (comprising a substrate such as a PCBA, and LED light emitters) is installed on the base 2*a*.

The stepped sealing ring 4*a* is sheathed on the second circumferential side surface 102 of the lens 1*a* such that the internal peripheral surface 43 of the stepped sealing ring 4*a* fits the second circumferential side surface 102.

The annular protruding wall 201*a* of the base 2*a* is inserted into the annular groove 10*a* of the lens 1*a* such that external circumferential surface 421 of the cylindrical portion having the smaller radial size 42 of the stepped sealing ring 4*a* comes into contact with the fourth circumferential side surface 204 of the base 2*a*.

The lens 1*a* and the base 2*a* are screwed down by rotating along the threads, such that the first end face 411 of the first flange 41 of the stepped sealing ring 4*a* comes into contact with the second bottom surface 104 of the annular groove 10*a* in the lens 1*a*, and the axial end face 412, close to the end 42 having the smaller radial size, of the first flange 41 of the stepped sealing ring 4*a* comes into contact with the second transitional mesa 203 of the base 2*a*.

The sealing structure of the stepped sealing ring 4*a* in the present invention is as follows.

The first end face 411 of the first flange 41 of the stepped sealing ring 4*a* is in contact with the second bottom surface 104 of the lens 1*a*, and the axial end face 412, close to the cylindrical portion having the smaller radial size 42, of the first flange 41 comes into contact with the second transitional mesa 203 of the base 2*a*. In addition, the internal peripheral surface 43 of the stepped sealing ring 4*a* is in contact with the second circumferential side surface 102 of the lens 1*a*, and the external circumferential surface 421 of the cylindrical portion having the smaller radial size 42 of the stepped sealing ring 4*a* is in contact with the fourth circumferential side surface 204 of the base.

When the lens 1*a* or the base 2*a* is rotated such that the lens 1*a* and the base 2*a* get close to each other, the first flange 41 of the stepped sealing ring 4*a* is squeezed to deform between the second bottom surface 104 of the lens 1*a* and the second transitional mesa 203 of the base 2*a*, leading to tighter contact of the first end face 411 of the first flange 41 of the stepped sealing ring 4*a* with the second bottom surface 104 of the lens 1*a* and tighter contact of the axial end face 412, close to cylindrical portion having the smaller radial size 42, of the first flange 41 with the second transitional mesa 203 of the base 2*a*, thereby achieving good sealing.

Additionally, a plurality of groups of barbs 422 are disposed on the external circumferential surface 421 of the cylindrical portion having the smaller radial size 42 of the stepped sealing ring 4*a*. As the barbs point to the first flange 41, the barbs are squeezed to deform in the rotation process, leading to tighter fit and good sealing of the barbs with the fourth circumferential side surface 204 of the base 2*a*. On the other hand, the barbs, while deforming, may squeeze the second circumferential side surface 102 of the lens 1*a*, leading to tighter contact of the internal peripheral surface 43 of the stepped sealing ring 4*a* with the second circumferential side surface 102 of the lens 1*a*, thus further achieving good sealing.

Furthermore, the external circumferential surface 421 of the cylindrical portion having the smaller radial size 42 of the stepped sealing ring 4*a* is the circular conical surface. Thus, in the process that the lens 1*a* and the base 2*a* are screwed tight and holding down the stepped sealing ring 4*a*, on one hand, a good guiding effect is achieved due to that the shape of the cylindrical portion having the smaller radial size 42 of the stepped sealing ring 4*a* increases gradually from bottom to top, which facilitates inserting of the annular protruding wall 201*a* of the base 2*a* into the annular groove 10*a* of the lens 1*a*. Moreover, the section of the cylindrical portion having the smaller radial size 42 of the stepped sealing ring 4*a* is wedge-shaped, and an acting force applied in the axial direction of the stepped sealing ring 4*a* becomes greater and greater with an increasing smaller distance between the lens 1*a* and the base 2*a* in the process that the lens 1*a* and the base 2*a* are screwed tight and holding down the stepped sealing ring 4*a*, leading to tighter fit between the stepped sealing ring 4*a* and the lens 1*a* and tighter fit between the stepped sealing ring 4*a* and the base 2*a*.

In this embodiment, the upper surface of the annular protruding wall of the base may also be provided with a groove which is filled with a sealant.

In other implementations of the present invention, the external thread may also be disposed on the lens assembly, while the internal thread is disposed on the base. The sealing ring and the corresponding structure may then be adjusted appropriately. For example, the stepped sealing ring in this embodiment is inverted. The specific mode can be determined by a person skilled in the art through simple conversion, which will not be described in detail herein.

In this embodiment, a plurality of fins are disposed on the lower end of the base 2*a*, which include a plurality of flaky fins and a plurality of columnar fins. The flaky fins are disposed in a middle position, and the columnar fins are disposed around the flaky fins, wherein the flaky fins function in increasing the heat dissipation area and the columnar fins function in improving the overall structural strength. As the flaky fins and the columnar fins are combined as the heat dissipation portion of the base 2*a* in the present invention, the heat dissipation effect is guaranteed and the strength of the base is enhanced as compared to the base in the prior art. Certainly, in other implementations, there may be no fins on the lower end face of the base, and the whole LED module is cooled directly by means of the base 2*a*. Whether the fins are disposed on the base and how the fins are disposed may be designed according to specific circumstances and requirements, which are not limited herein.

In this embodiment, a waterproof joint 7 is also disposed on the other side of the base 2*a*. One end of the waterproof joint 7 is connected to a waterproof wire, and the other end passes through the base 2*a* and is connected to the light source assembly 3*a*. Moreover, a wire passing hole sealing ring 6 is also disposed between the waterproof joint 7 and the base 2*a* for sealing. Certainly, the waterproof wire may also be disposed outside the LED module to achieve power supply to the LED light emitters, which is not limited herein.

The present invention also provides a lighting device. A plurality of LED modules are disposed in the lighting device, and each LED module is the LED module as described above, which will not be redundantly described herein.

Embodiment 2

Figure 6:
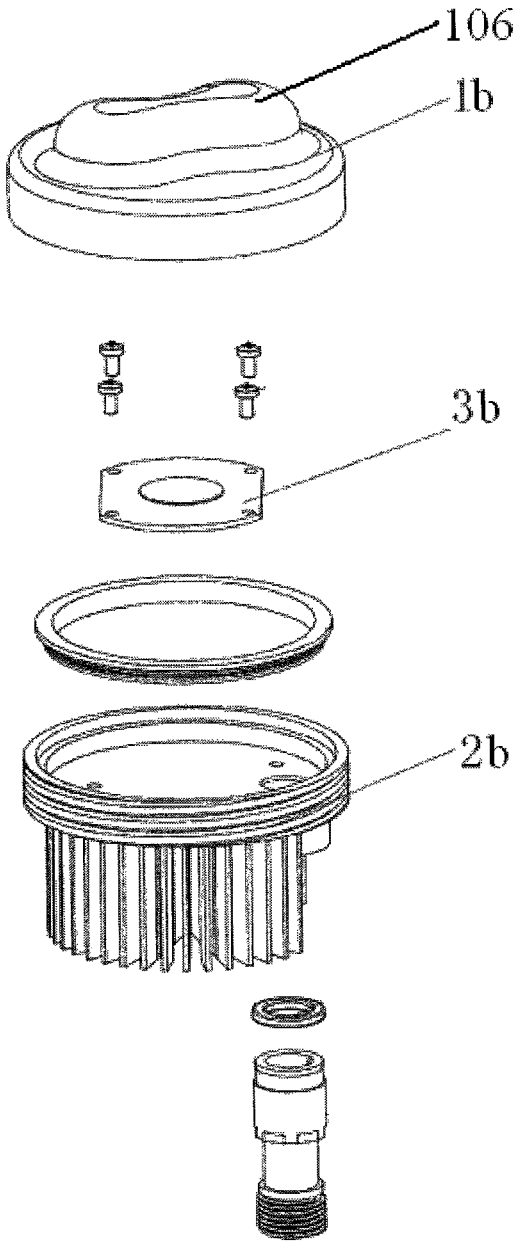
FIG. 6 is an exploded schematic diagram of embodiment 2 of the present invention.

Referring to FIG. 6, the embodiment provides an LED module comprising a lens assembly, a base 2*b*, and a light source assembly 3*b*. The lens assembly is installed on the upper end face of the base 2*b*, and the two are connected by means of threads to form a closed accommodating space therebetween. The light source assembly 3*b* is located in the accommodating space. A plurality of fins are disposed on the lower end of the base 2*b* for dissipating heat.

In this embodiment, the lens assembly is a light distribution lens 1*b*. A protruding light distribution structure 106 is disposed on the upper end of the lens such that the light module may be applied to a streetlamp and also to other lamps needing light distribution, which is not limited herein. The protruding light distribution structure 106 of the lens 1*b* is asymmetrical, and an installation direction of the lens 1*b* in the circumferential direction may be determined according to a light irradiation direction requirement. Other structures of the LED module in this embodiment may all refer to the descriptions in the embodiment 1, which will not be redundantly described herein.

This embodiment also provides a lighting device. A plurality of LED modules are disposed in the lighting device, and each LED module is the module as described above, which will not be redundantly described herein.

Embodiment 3

Figure 7:
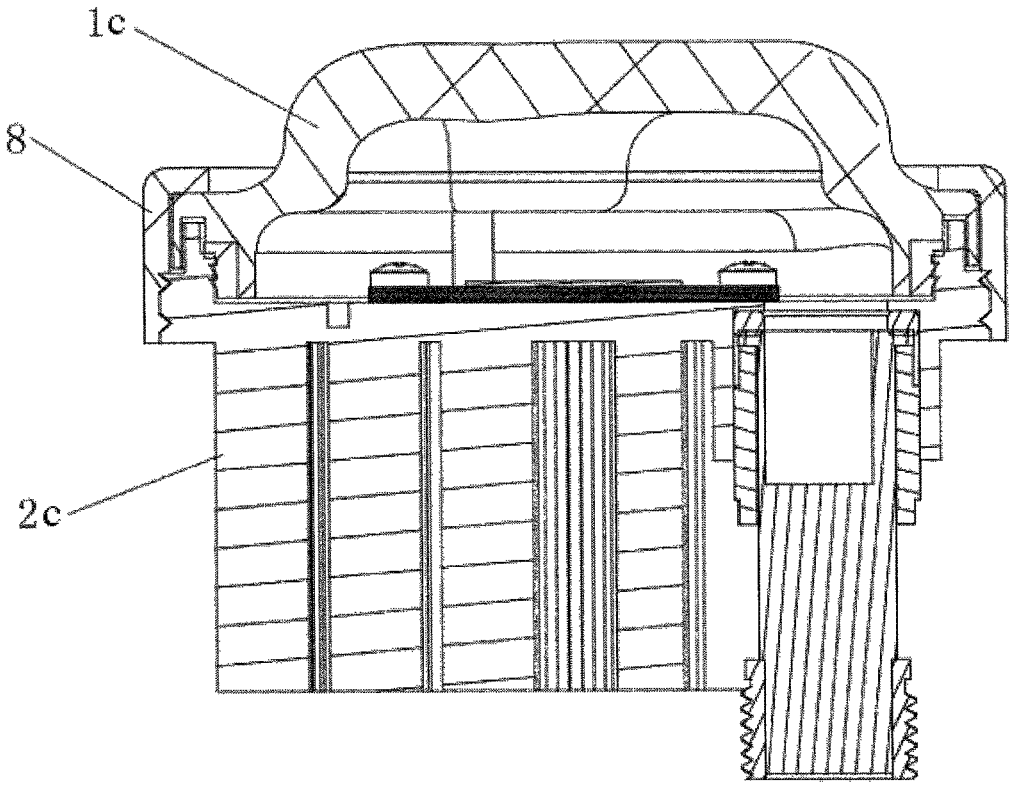
FIG. 7 is a sectional diagram of embodiment 3 of the present invention.
Figure 8:
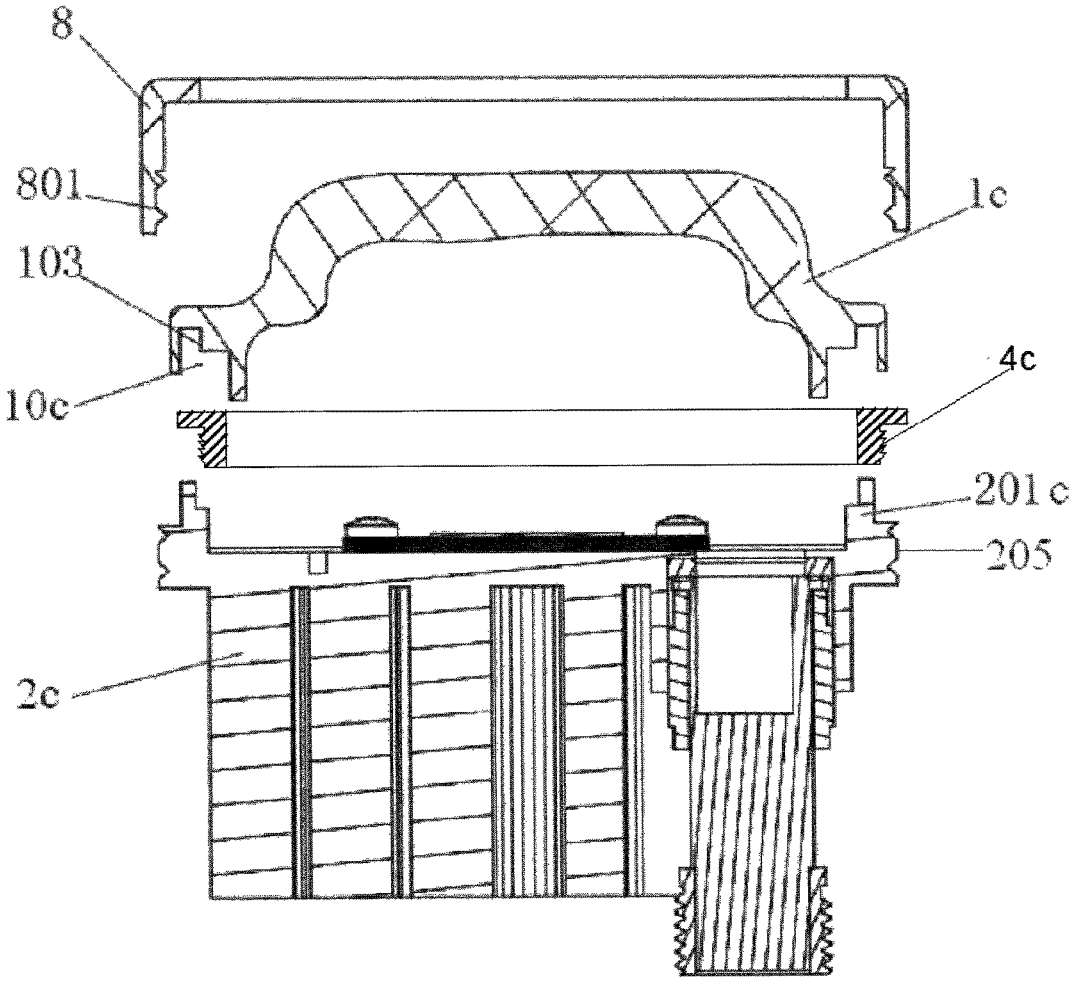
FIG. 8 is an exploded diagram of embodiment 3 of the present invention.

Referring to FIG. 7 and FIG. 8, this embodiment provides an LED module comprising a lens assembly, a base 2*c*, and a light source assembly 3*c*. The lens assembly is installed on the upper end face of the base 2*c*, and the two are connected by means of threads to form a closed accommodating space therebetween. The light source assembly 3*c* is located in the accommodating space. A plurality of fins are disposed on the lower end of the base 2*c* to form a radiator for dissipating heat.

In this embodiment, as shown in FIG. 7, the lens assembly is composed of a lens 1*c* and a lens pressing ring 8, wherein the lens pressing ring 8 is preferably made of a metal material so that the lens pressing ring 8 can have good strength and be prevented from damage such as cracks. The lens 1*c* is provided with an edge portion and a lens portion protruding up with respect to a radial circumferential surface of the edge portion, wherein the radial size of the edge portion is greater than that of the lens portion protruding up, and the edge portion is provided with an opening facing the base 2*c*. The lens 1*c* is circumferentially provided along an edge thereof with an annular groove 10*c*, and the interior structure of the annular groove 10*c* is disposed identical to that of embodiment 1. Certainly, in other implementations of the present invention, the annular groove may also be disposed different from embodiment 1, for example, having multiple steps, which is not limited herein.

Referring to FIG. 8, a circle of annular protruding wall 201*c* is disposed above the outer edge end surface of the base 2*c*. The shape of the annular protruding wall 201*c* matches that of the annular groove 10*c* disposed on the lens 1*c*, and the light source assembly 3*c* is placed in an area enclosed by the annular protruding wall 201*c*. The structure of the internal side surface of the annular protruding wall 201*c* is disposed identical to that of embodiment 1.

In this embodiment, an internal thread 801 is disposed in a circle on the inner sidewall of the lens pressing ring 8, and an external thread 205 matching the internal thread 801 is disposed on the outer sidewall of the lower portion of the annular protruding wall 201 of the base 2*c*. The lens pressing ring 8 presses against the upper end face of the edge portion of the lens 1*c*, and is connected to the base 2*c* by means of connection of the internal thread 801 and the external thread 205, thereby further achieving fixed connection between the lens 1*c* and the base 2*c*.

Furthermore, according to this embodiment, a positioning column is disposed at one side, opposite to the base 2*c*, of the lens 1*c* and a positioning hole is correspondingly provided in the upper end face of the base 2, and the positioning column and the positioning hole are matched and connected to achieve positioning of the lens assembly to meet the requirement of light polarization design.

Specifically, the connection of the lens 1*c* and the base 2*c* is achieved by means of the annular protruding wall 201*c* extending into the annular groove 10*c*. In this embodiment, a sealing ring is also disposed between the annular groove 10*c* and the annular protruding wall 201*c* to enhance the sealing effect between the lens 1*c* and the base 2*c*. The sealing ring is preferably a stepped sealing ring 4*c*. Further preferably, a sealant is also disposed between the annular groove 10*c* and the annular protruding wall 201*c* to further enhance the sealing effect between the lens 1*c* and the base 2*c*.

In this embodiment, the light distribution component and the connection component of the lens assembly are separated, and such a separation allows for many options of materials for the lens.

Light distribution mainly depends on the shape and size of the lens portion and the relative position to an LED light-emitting element. Typically, lens groups have different light distribution schemes corresponding to different lighting environment, and there may often be a plurality of light distribution schemes and a plurality of lens groups for the same batch of products. If the lens groups and the threaded connection portion are integrally molded, design of a plurality of sets of molds is required. Moreover, the costs of the molds for integrally molding the lens groups and the threaded connection portion are high, and the costs of repeated mold repair are also high. The threaded connection portion is separated from the lens groups into two elements which are molded separately, and therefore, only one set of molds is needed for the threaded connection portion. Additionally, the mold for the lens groups is just designed individually. Thus, the mold for the lens groups is simplified, and the costs of designing a plurality of sets of molds or repairing molds both are reduced.

The light transmittance performance, mechanical properties and outdoor performance of materials need to be taken into account in material selection for the lens groups with low production costs being considered simultaneously. When the threaded connection portion and the lens groups are molded integrally, the optical properties of materials need to be taken into account while the mechanical properties thereof are considered. If the threaded connection portion is separated from the lens groups, the requirement for the mechanical properties of the material selection for the lens groups may be relatively reduced, and the mold for production may also be simplified with reduced costs in large-scale production. In addition, the range of optional materials for the lens groups is increased, and different materials are used for different property requirements. For example, in case of a higher requirement on flame retardance, glass and the like having higher flame retardance may be employed, and the problem of poor elastic properties of the glass is avoided; in case of a higher requirement on strength, an organic glass material may be employed, and the problem of poor elastic properties of the organic glass is avoided; and in case of a higher requirement on light transmittance, PMMA (acrylic) may be employed, and the problem of insufficient strength and easy breakage of the PMMA (acrylic) is avoided.

In addition, the material of the pressing ring may be a transparent material, or a material which is poor in light transmittance performance but easy to manufacture, low in cost and good in both mechanical properties and machining properties, such as a metal material.

The present invention also provides a lighting device. A plurality of LED modules are disposed in the lighting device, and each LED module is the LED module as described above, which will not be redundantly described herein.

Embodiment 4

Figure 9:
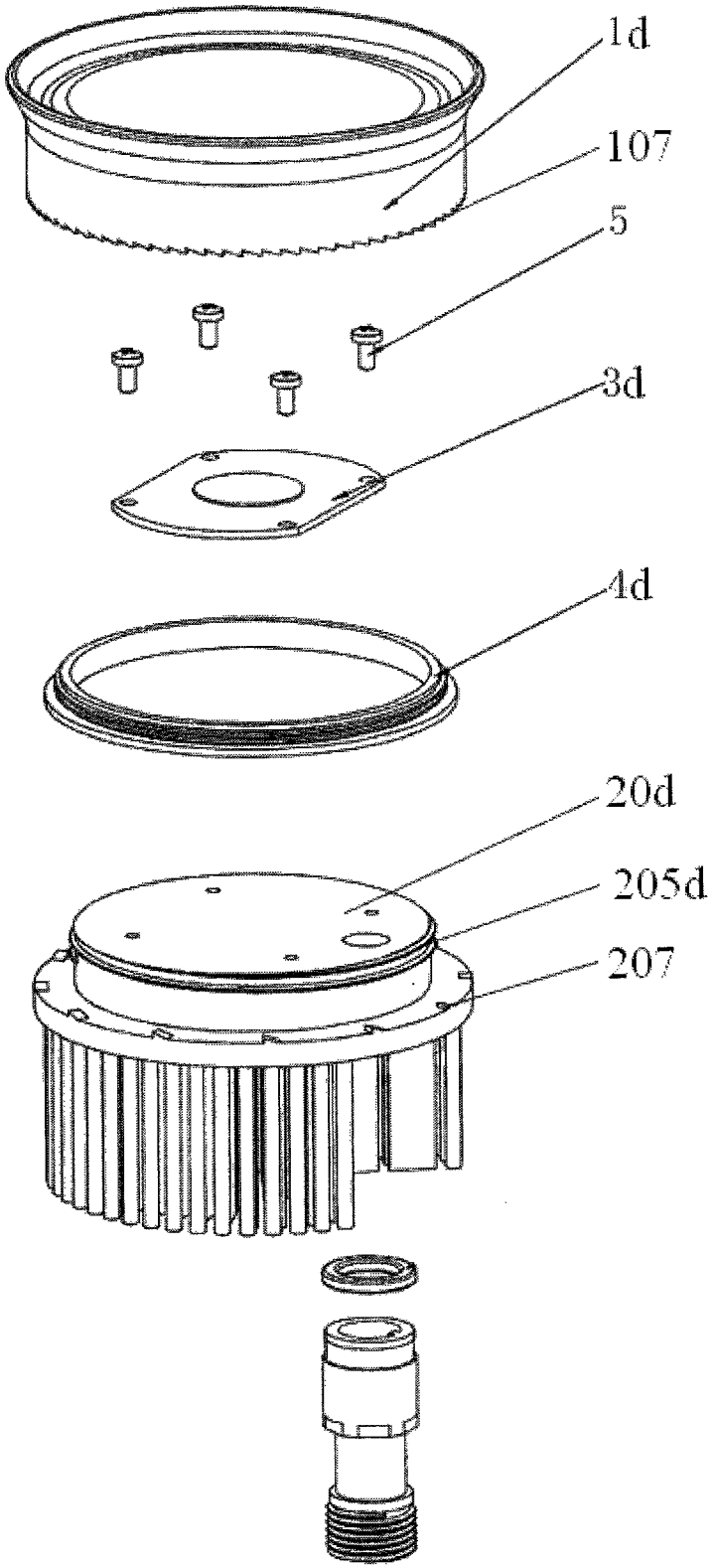
FIG. 9 is an exploded schematic diagram of embodiment 4 of the present invention.
Figure 10:
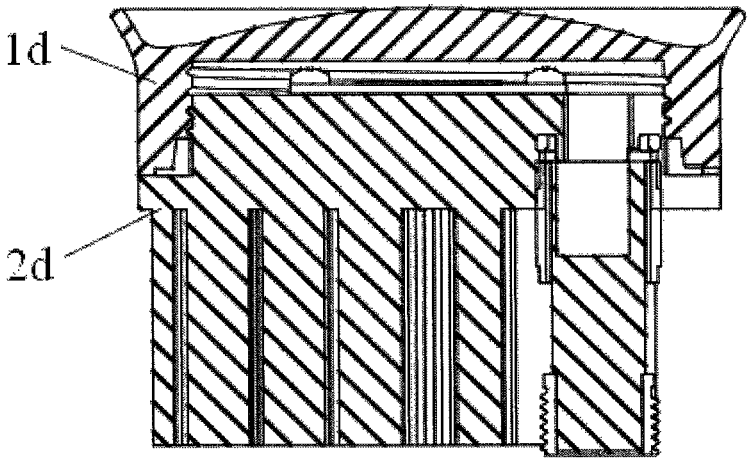
FIG. 10 is a sectional diagram of embodiment 4 of the present invention.

Referring to FIGS. 9 and 10, this embodiment provides an LED module comprising a lens assembly, a base 2*d*, and a light source assembly 3*d*. The lens assembly is installed on the base 2*d*, and the two are connected by means of threads to form a closed accommodating space therebetween. The light source assembly 3*d* is located in the accommodating space. A plurality of fins are disposed on the lower end of the base 2*c* for dissipating heat.

In this embodiment, the lens assembly comprises a lens 1*d*. The lens 1 is shaped as a bottle cap and an end thereof facing the base is open. The lens 1*d* may be an integrally injection-molded lens or a combined assembly lens, which is not limited herein. The lens 1*d* comprises a lens portion and a connection portion for connection with the base. The connection portion is cylindrical and one side thereof adjacent to the base 2*d* is open. A first equidirectional tooth-shaped structure 107 is disposed at the circumferential edge, facing the base 2*d*, of the connection portion. The first equidirectional tooth-shaped structure 107 specifically comprises a plurality of notches that are disposed along the circumferential edge, facing the base 2*d*, of the connection portion of the lens 1*d* and preferably uniformly disposed facing the same direction. Moreover, an internal thread is disposed on the inner sidewall of the connection portion of the lens 1*d*. A protruding wall is disposed at the periphery of the light-exiting surface of the lens portion of the lens 1*d*. A light-reflecting layer is disposed on the internal side surface of the protruding wall to improve luminous efficacy.

A protruding base 20*d* is disposed at one side, connected with the lens 1*d*, of the base 2*d*. The light source assembly 3*d* is installed on the base 20*d* by means of a connection structure such as a screw 5. An external thread 205*d* matching the internal thread is disposed in a circle on the outer sidewall of the base 20*d*. A second equidirectional tooth-shaped structure 207 matching the first equidirectional tooth-shaped structure 107 is disposed at one side, connected with the lens 1*d*, of the base 2*d* and located in surrounding directions of the bottom of the base 20*d*. Moreover, the first equidirectional tooth-shaped structure 107 and the second equidirectional tooth-shaped structure 207 face opposite directions.

When the LED module of this embodiment is assembled, the connection portion of the lens 1*d* are sheathed outside the base 20*d*, and rotary connection of the base 2*d* is achieved by means of the first thread and the second thread 205*d*. After the lens 1*d* is rotated in place, the first equidirectional tooth-shaped structure 107 disposed on the connection portion of the lens 1*d* and the second equidirectional tooth-shaped structure 207 on the base 2*d* are engaged to achieve automatic locking. Also, this embodiment may achieve accurate positioning of the lens requiring light distribution by adjusting the thread connection and the matching of the two connection ways that the first equidirectional tooth-shaped structure and the second equidirectional tooth-shaped structure.

According to the LED module of this embodiment, rotary connection between the lens 1*d* and the base 2*d* is achieved in a threaded connection way, and automatic locking of the base 2*d* and the lens 1*d* is achieved by means of engagement between the first equidirectional tooth-shaped structure 107 and the second equidirectional tooth-shaped structure 207. Thus, the connection between the lens 1*d* and the base 2*d* is strengthened, thereby preventing the two from becoming loose.

In addition, this embodiment employs the connection way of threads in combination with the tooth-shaped structures. Compared to the connection ways such as snap fitting or using a screw between the lens and the base in the prior art, in this embodiment, the lens is connected with the base in such a manner of being held down on the base, and the contact surface of the lens and the base bears the force. As a result, a large and even force bearing surface and a better sealing effect are achieved.

Referring to FIG. 9 and FIG. 10, in this embodiment, a sealing ring is also disposed between the lens 1*d* and the base 2*d* to enhance the sealing effect between the lens 1*d* and the base 2*d*, wherein the sealing ring is preferably a stepped sealing ring 4*d* to achieve a better sealing effect. The setting location, setting manner and the sealing principles of the stepped sealing ring is identical to that of embodiment 1, and the specific structure and settings thereof are shown in FIG. 10.

Other structures of the LED module in this embodiment may all refer to the descriptions in the embodiment 1, which will not be redundantly described herein.

This embodiment also provides a lighting device. A plurality of LEDs are disposed in the lighting device, and each LED module is the module as described above, which will not be redundantly described herein.

Embodiment 5

Figure 11:
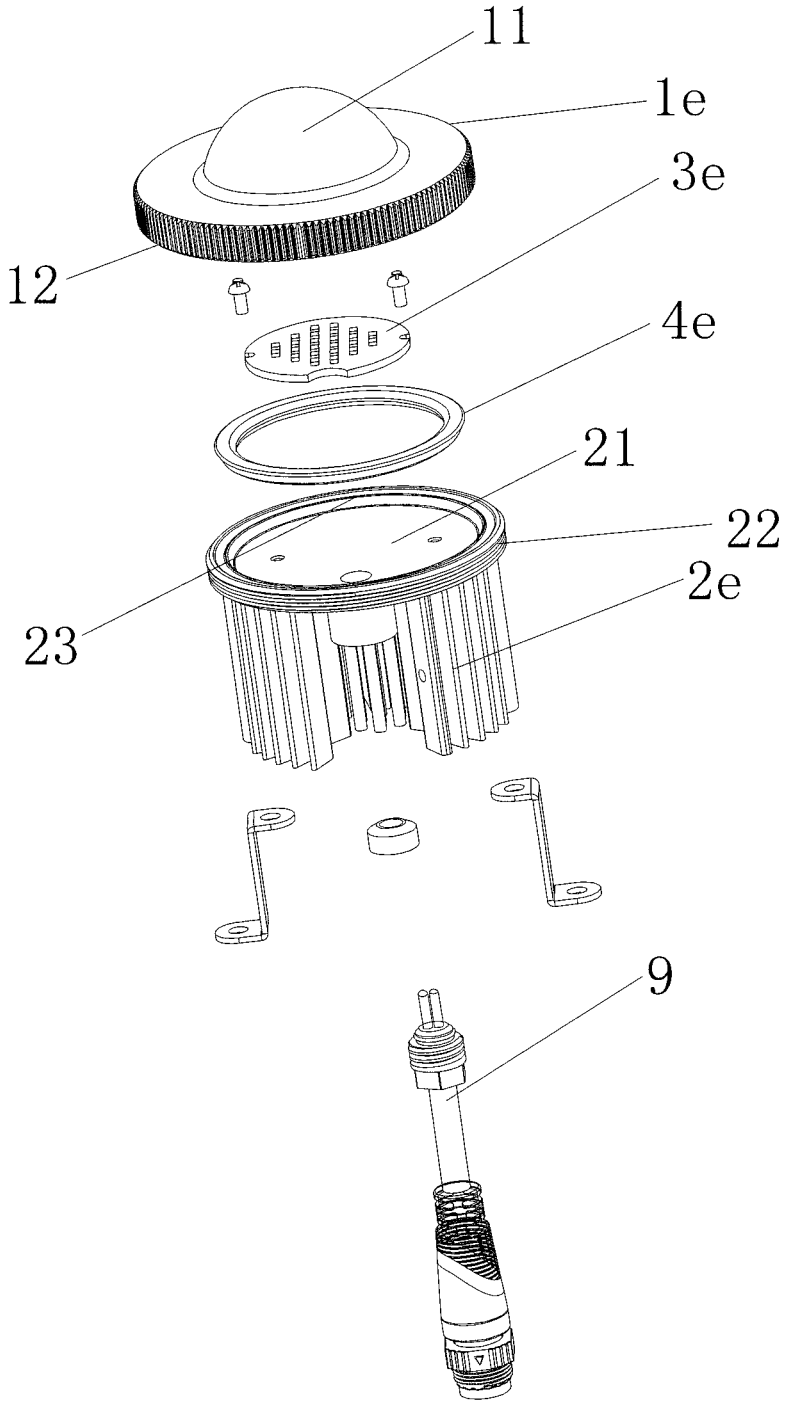
FIG. 11 is an exploded schematic structure diagram of embodiment 5 of the present invention.
Figure 12:
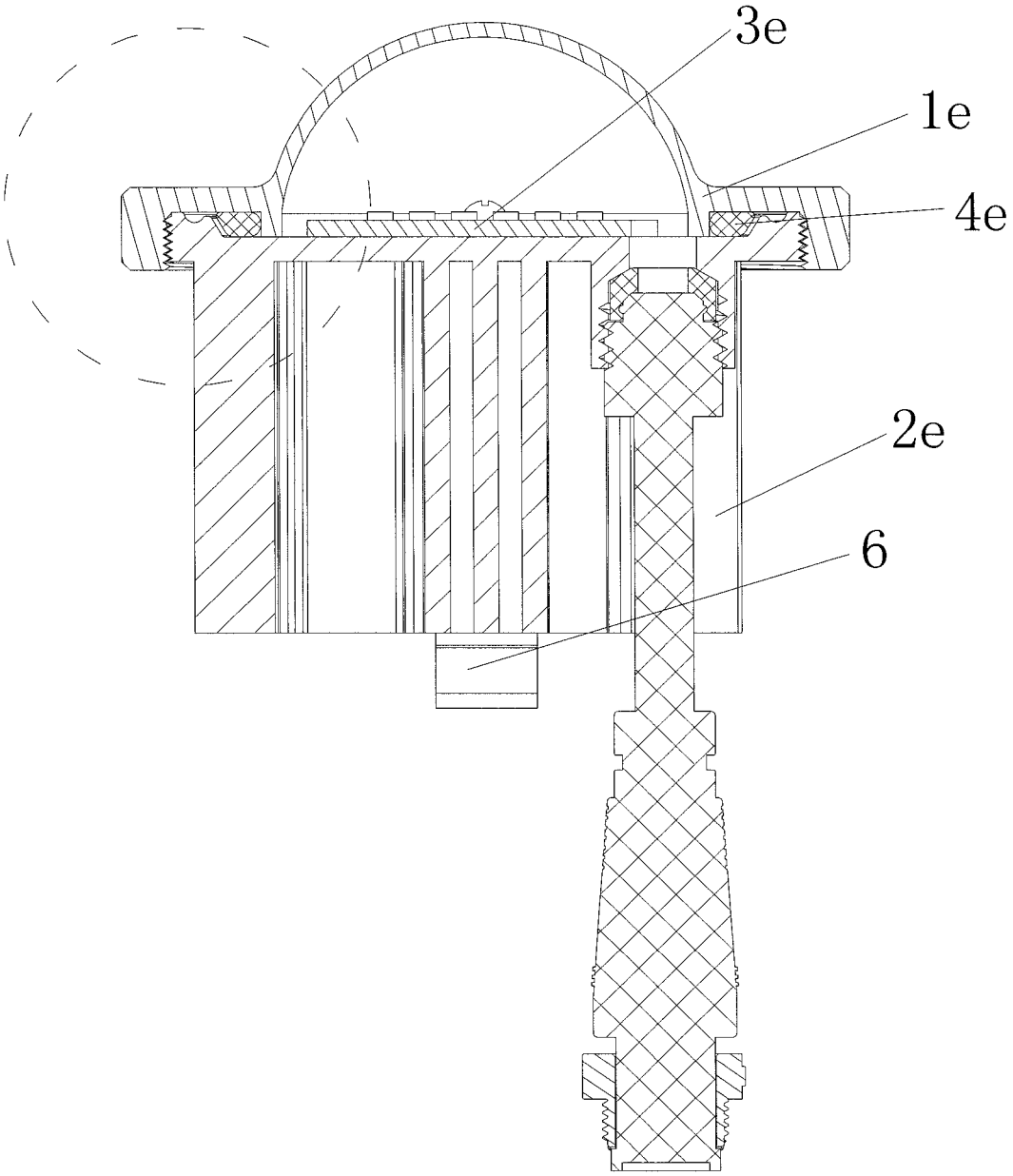
FIG. 12 is a sectional diagram of embodiment 5 of the present invention with a circular portion indicated by dash-dotted line being further shown in FIG. 13.
Figure 13:
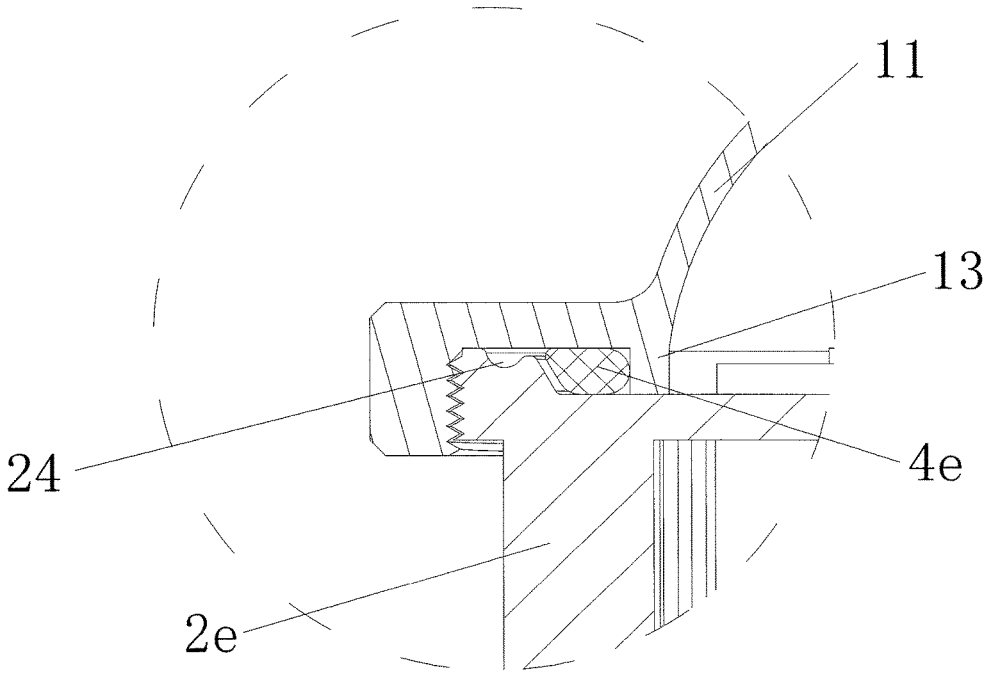
FIG. 13 is a partial enlarged diagram of a portion where a lens assembly and a base are connected in embodiment 5 of the present invention.

Referring to FIG. 11 to FIG. 13, this embodiment provides an LED module comprising: a PCBA 3*e* electrically connected with the at least one LED light-emitting element; a base 2*e* usable to support the PCBA, the base 2*e* being disposed on an installation support 6; a lens assembly disposed above a light-emitting surface of the LED light-emitting element; and a sealing ring 4*e* held down between the lens assembly and the base 2*e* for sealing. The PCBA is located in a closed space formed by the lens assembly and the base. In this embodiment, the lens assembly is an integrally molded lens 1*e*, which comprises a lens portion. Specifically, the lens portion is bulb-shaped and the called a bulb portion 11. The bulb portion 11 is provided with a groove. The edge extending outwards of the groove is provide with a first threaded connection portion 12 integrally connected with the bulb portion 11, and an internal thread is disposed on the first threaded connection portion 12. A second threaded connection portion 22 (the second threaded connection portion is equivalent to the annular protruding wall of the base in embodiment 1) matching the first threaded connection portion 12 is disposed on the base 2*e*, and an external thread is disposed on the second threaded connection portion 22. The lens 1*e* and the base 2*e* are fixedly connected by means of the first threaded connection portion 12 disposed on the lens 1*e* and the second threaded connection portion 22 disposed on the base 2*e*, and the sealing ring 4*e* is held down in the axial direction of the threaded connection portion of the lens 1*e*.

Referring to FIG. 12 and FIG. 13, in this embodiment, the sealing ring 4*e* is formed by an internal circumferential surface, a first end face, a circular conical surface and a second end face that are sequentially connected, and the first end face is a bottom surface having a greater radial size of a circular cone. Correspondingly, the lens assembly is provided with a third matching structure matching the stepped sealing ring, and the base is provided with a fourth matching structure matching the stepped sealing ring.

Referring to FIG. 13, an annular lug boss 13 is disposed on the side, facing the LED light-emitting element, of the lens 1*e* and in a direction close to the LED light-emitting element. The annular lug boss 13 is located at the inner side of the first threaded connection portion 12 with a distance therebetween to form a second groove bottom surface, wherein the external circumferential surface of the annular lug boss and a portion of the second groove bottom surface adjacent thereto together form the third matching structure. The sealing ring 4*e* is sheathed on the external circumferential surface of the annular lug boss 13, and the internal circumferential surface of the sealing ring 4*e* tightly fits the external circumferential surface of the annular lug boss 13. In other implementations of the present invention, the internal circumferential surface of the sealing ring may also be a circular conical surface.

Referring to FIG. 11, the base 2*e* is provided with a second annular groove which comprises a bottom surface 21 and a slope-shaped internal side surface 23. A second annular protruding wall is formed to surround the second annular groove, which serves as the second threaded connection portion 22. The internal side surface of the second annular groove of the base and a portion of the bottom surface adjacent thereto together form the fourth matching structure.

In this embodiment, before assembling the LED module, the first end face of the sealing ring 4*e* fits the lens 1*e*, and the internal circumferential surface of the sealing ring 4*e* tightly fits the external circumferential surface of the annular lug boss 13.

The sealing ring 4*e* is held down by relative rotation between the lens 1*e* and the base 2*e* during assembling of the LED module. The second end face of the sealing ring 4*e* firstly fits the edge portion of the bottom surface 21 of the groove in the base 2*e*. Then, as the sealing ring 4*e* is further held down due to continuous relative rotation of the lens 1*e* and the base 2*e*, the sealing ring 4*e* is squeezed to deform in the axial direction, and the internal circumferential surface of the sealing ring 4*e* fits the external peripheral surface of the annular lug boss 13. The sealing ring 4*e* can only deform as expanding outwards in the radial direction, and the expanding deformation of the sealing ring 4*e* in the radial direction will become more and more obvious with an increasingly smaller distance between the lens 1*e* and the base 2*e* in the axial direction, causing the circular conical surface of the sealing ring 4*e* to gradually fit the slope-shaped internal side surface 23 of the base 2*e*.

After the sealing ring 4*e* is held down, the circular conical surface thereof fits the slope-shaped internal side surface 23 of the base, and the second end face of the sealing ring 4*e* fits the edge portion of the bottom surface 21 of the groove in the base 2*e*.

In this embodiment, the principle of achieving sealing with the wedge-shaped sealing ring 4*e* is as follows.

The sealing ring is sheathed outside the annular lug boss with the internal circumferential surface thereof tightly fitting the outside circumferential surface of the annular lug boss. When the lens is in threaded connection with the base, as squeezed by the lens, the circular conical surface of the sealing ring fits the slope surface of the base and the second end face of the sealing ring fits the edge of the bottom surface of the groove in the base. Thus, in the process of holding down the sealing ring, on one hand, a good guiding effect is achieved due to that the external circumferential surface of the sealing ring is the circular conical surface, which facilitates inserting of the lens into the base. Moreover, in this case, the section of the sealing ring is wedge-shaped, and an acting force applied in the axial direction of the sealing ring becomes greater and greater with an increasingly smaller distance between the lens assembly and the base in the process of rotatably holding down the sealing ring, leading to tighter fit between the stepped sealing ring and the lens assembly and tighter fit between the stepped sealing ring and the base, thereby achieving sealing.

Preferably, in this embodiment, an annular groove 24 is also provided in the second threaded connection portion 22 of the base 2*e* and at a position on the outer side of the sealing ring 4*e*. The annular groove 24 is internally coated with glue for sealing. Moreover, the height of the end, close to the light-emitting element, of the annular groove 24 is lower than the end far away from the light-emitting element, thereby preventing the glue from overflowing out of the LED module when being pressed in the installation process of the lens assembly and the base. In other implementations of the present invention, the annular groove 24 may also be disposed at a position on the inner side of the sealing ring on the base 2*e*.

In addition, referring to FIG. 11, in this embodiment, a plurality of lug bosses for preventing sliding are also disposed on the external circumferential surface of the first threaded connection portion 12 of the lens 1*e*.

In other implementations of the present invention, the bulb portion of the lens assembly may also be replaced with an irregular convex mirror for light distribution.

Preferably, the first threaded connection portion on the lens assembly and the second threaded connection portion on the base may be double threads matching each other. The provision of the double threads results in that the lens assembly can only be rotated into the base from a fixed position. Thus, when a rotation angle is set, the consistency of the position of the lens assembly installed on the base may be guaranteed. Moreover, especially when the bulb portion of the lens assembly is designed with a special light distribution structure, the positions of the lens assembly and a light-emitting chip are required to be relatively fixed according to the light distribution requirement. The design of the double-thread structure may ensure that the relative position of the lens installed on the base to the base is disposed as required and different LED modules are kept constant, thereby guaranteeing the light distribution design.

Referring to FIG. 11 and FIG. 12, in this embodiment, the base 2*e* is provided with a through hole allowing a conductor connecting to a power source to pass through. Specifically, the conductor is disposed within a waterproof wire 9, and the connection position of the conductor and the base 2*e* is sealed by means of a sealing ring to ensue the sealing waterproofness of the whole LED module.

In this embodiment, fins are disposed on the base 2*e*, and the structure thereof is specifically disposed identical to that of embodiment 1, which will not be redundantly described herein.

In conclusion, the present invention provides an LED module comprising a base, a lens assembly, and a light source assembly. The light source assembly is disposed at one side of the base. The lens assembly is connected with the base to form a closed accommodating space in which the light source assembly is located. Moreover, the lens assembly is in rotary threaded connection with the base. A sealing ring is also disposed at the connection position of the lens assembly and the base, and a sealant may further be disposed. The lens assembly and the base in the LED module provided in the present invention are in threaded connection with each other, providing an increased force bearing surface and even force bearing between the lens assembly and the base, thus resulting in a secure connection and good leakproofness between the base and the lens assembly and convenient installation and removal of the base and the lens assembly. In addition, the sealing ring is disposed at the connection of the lens assembly and the base, and a sealant may be further disposed, thereby allowing for an excellent sealing effect between the lens assembly and the base.

A person skilled in the related technical field should understand that the present invention may be implemented in many other specific forms without departing from the spirit or scope of the present invention. While the embodiments of the present invention are described above, it should be appreciated that the present invention should not be limited to these embodiments. A person skilled in the related technical field may make alterations and modifications within the spirit and scope defined by the appended claims.

The invention claimed is:

1. An LED module, comprising:

a base, a lens assembly, and a light source assembly, wherein the lens assembly is provided with an internal thread, and the base is correspondingly provided with an external thread matching the internal thread, wherein the lens assembly and the base are connected by means of the threads to form a closed accommodating space therebetween; moreover, a sealing ring is also disposed at a portion between a threaded connection of the base and the lens assembly and the accommodating space; and the light source assembly is located in the accommodating space, and disposed at one side of the base, the lens assembly comprises a lens portion and a threaded connection portion, and the lens portion and the threaded connection portion are integrally molded or fixedly connected.

2. The LED module of claim 1, wherein: the sealing ring is a stepped sealing ring that comprises a cylindrical portion having a greater peripheral radial size and a cylindrical portion having a smaller peripheral radial size; the lens assembly is provided with a first matching structure matching the stepped sealing ring, and the base is provided with a second matching structure matching the stepped sealing ring.

3. The LED module of claim 2, wherein:

the lens assembly is provided with an annular protruding part in a direction from a peripheral edge thereof to the base; the annular protruding part is a hollow cylinder with a thickness; the annular protruding part is provided with an annular groove and an opening of the annular groove faces the base; the annular groove is formed by a first circumferential side surface, a second circumferential side surface, and a groove bottom surface; the first circumferential side surface is located at a periphery of the second circumferential side surface, and provided with the internal thread; and the groove bottom surface and the second circumferential side surface together form the first matching structure; and the external thread of the base and the second matching structure are disposed as follows: an annular protruding wall is disposed on an end face of the base that facing the lens assembly, and the light source assembly is located in an area enclosed by the annular protruding wall; the annular protruding wall is capable of being placed into the annular groove of the lens assembly, and an external side surface of the annular protruding wall is provided with the external thread; and an upper surface of the annular protruding wall and an internal side surface of the annular protruding wall together form the second matching structure.

4. The LED module of claim 2, wherein:

the lens assembly is provided with an annular protruding part in a direction from a peripheral edge thereof to the base; the annular lug boss is a hollow cylinder with a thickness; the annular lug boss is provided with an annular groove and an opening of the annular groove faces the base; the annular groove is formed by a first circumferential side surface, a second circumferential side surface, and a groove bottom surface; the first circumferential side surface is located at a periphery of the second circumferential side surface, and provided with the internal thread; the groove bottom surface is stepped and comprises a deeper first bottom surface, a shallower second bottom surface, and a first transitional mesa therebetween; the first bottom surface adjoins the first circumferential side surface; the second bottom surface adjoins the second circumferential side surface; and the second bottom surface and the second circumferential side surface together form the first matching structure; and the external thread of the base and the second matching structure are disposed as follows: an annular protruding wall is disposed on an end face of the base that facing the lens assembly, and the light source assembly is located in an area enclosed by the annular protruding wall; the annular protruding wall is capable of being placed into the annular groove of the lens assembly, and an external side surface of the annular protruding wall is provided with the external thread; an internal side surface of the annular protruding wall is stepped and comprises a third circumferential side surface located in the upper part, a fourth circumferential side surface located in the lower part, and a second transitional mesa therebetween, and the fourth circumferential side surface and the second transitional mesa together form the second matching structure.

5. The LED module of claim 4, wherein: an upper surface of the annular protruding wall of the base is provided with a groove which is filled with a sealant.

6. The LED module of claim 4, wherein: the annular protruding part of the lens assembly is circumferentially provided along an edge thereof with a first equidirectional tooth-shaped structure; the base is provided with a second equidirectional tooth-shaped structure matching the first equidirectional tooth-shaped structure; and after the lens assembly is connected with the base by means of the threads, the first equidirectional tooth-shaped structure is engaged and locked with the second equidirectional tooth-shaped structure.

7. The LED module of claim 3, wherein: an upper surface of the annular protruding wall of the base is provided with a groove which is filled with a sealant.

8. The LED module of claim 3, wherein: the annular protruding part of the lens assembly is circumferentially provided along an edge thereof with a first equidirectional tooth-shaped structure; the base is provided with a second equidirectional tooth-shaped structure matching the first equidirectional tooth-shaped structure; and after the lens assembly is connected with the base by means of the threads, the first equidirectional tooth-shaped structure is engaged and locked with the second equidirectional tooth-shaped structure.

9. The LED module of claim 2, wherein: a plurality of groups of barbs are disposed on an external circumferential surface of the cylindrical portion having the smaller peripheral radial size of the stepped sealing ring.

10. The LED module of claim 2, wherein: the external circumferential surface of the cylindrical portion having the smaller peripheral radial size of the stepped sealing ring is a circular conical surface, wherein the radial size of an end of the cylindrical portion that having the smaller peripheral radial size, which end connected with the cylindrical portion that having the greater peripheral radial size, is greater than that of the other end of the cylindrical portion that having the smaller peripheral radial size.

11. The LED module of claim 2, wherein: an axial section of the sealing ring is wedge-shaped, and an external circumferential surface of the sealing ring is a circular conical surface that big in top and small in bottom; correspondingly, the lens assembly is provided with a third matching structure matching the stepped sealing ring, and the base is provided with a fourth matching structure matching the stepped sealing ring.

12. The LED module of claim 11, wherein: a surface of the lens assembly that facing the light source assembly is provided with an annular lug boss, the annular lug boss is located inside the internal thread of the lens assembly, and the annular lug boss has a distance from the internal thread of the lens assembly to form a second groove bottom surface; the base is provided with a second annular groove that comprises a bottom surface and a slope-shaped internal side surface, and a second annular protruding wall is formed to surround the second annular groove, wherein an external circumferential surface of the annular lug boss and a portion of the second groove bottom surface adjacent thereto together form the third matching structure;

and an internal side surface of the second annular groove of the base and a portion of the bottom surface adjacent thereto together form the fourth matching structure.

13. The LED module of claim 12, wherein: an upper surface of the second annular protruding wall of the base is provided with a groove which is filled with a sealant.

14. The LED module of claim 1, wherein: the lens assembly is composed of a lens and a lens pressing ring; wherein the lens pressing ring presses the lens against the base, and the lens pressing ring is in threaded connection with the base.

15. The LED module of claim 14, wherein: a positioning column is disposed at a side of the lens that opposite to the base, and a positioning hole is correspondingly provided in an upper end face of the base.

16. The LED module of claim 1, wherein: the internal thread and the external thread are double threads matching each other.

17. The LED module of claim 1, wherein: the closed accommodating space formed by the lens assembly and the base is filled with a packaging gel.

18. The LED module of claim 1, wherein: one or more heat dissipation structures are disposed on a side of the base that departing from the lens assembly; each heat dissipation structure comprises a plurality of flaky fins and a plurality of columnar fins; the plurality of flaky fins are disposed in a middle position, and the plurality of columnar fins are disposed around the flaky fins.

19. The LED module of claim 1, wherein: a protruding wall is disposed at a periphery of a light-exiting surface of the lens assembly, and a light-reflecting layer is disposed on an internal side surface of the protruding wall.

20. A lighting device, characterized in that: at least one LED module is disposed in the lighting device, and the LED module is the LED module of claim 1.

21. An LED module, comprising:

a base, a lens assembly, and a light source assembly, wherein the lens assembly is provided with an external thread, and the base is correspondingly provided with an internal thread matching the external thread, and the lens assembly and the base are connected by means of the threads to form a closed accommodating space therebetween; moreover, a sealing ring is also disposed at a portion between a threaded connection of the base and the lens assembly and the accommodating space; and the light source assembly is located in the accommodating space, and disposed at one side of the base, the lens assembly comprises a lens portion and a threaded connection portion, and the lens portion and the threaded connection portion are integrally molded or fixedly connected.

* * * * *